US011974620B2

(12) United States Patent
Takechi et al.

(10) Patent No.: US 11,974,620 B2
(45) Date of Patent: May 7, 2024

(54) ARTIFICIAL HAIR, ARTIFICIAL HAIR UNIT, ARTIFICIAL HAIR APPLICATION METHOD, AND METHOD OF APPLYING ARTIFICIAL HAIR UNIT

(71) Applicant: KANEKA CORPORATION, Osaka (JP)

(72) Inventors: Keiko Takechi, Takasago (JP); Wataru Mio, Takasago (JP)

(73) Assignee: KANEKA CORPORATION, Osaka (JP)

( * ) Notice: Subject to any disclaimer, the term of this patent is extended or adjusted under 35 U.S.C. 154(b) by 343 days.

(21) Appl. No.: 17/226,676

(22) Filed: Apr. 9, 2021

(65) Prior Publication Data

US 2021/0227907 A1 Jul. 29, 2021

Related U.S. Application Data

(63) Continuation of application No. PCT/JP2019/039664, filed on Oct. 8, 2019.

(30) Foreign Application Priority Data

Oct. 12, 2018 (JP) ..... 2018-193423

(51) Int. Cl.
*A41G 3/00* (2006.01)
*A41G 5/00* (2006.01)

(52) U.S. Cl.
CPC ..... *A41G 3/0041* (2013.01); *A41G 3/0075* (2013.01); *A41G 5/004* (2013.01)

(58) Field of Classification Search
CPC ..... A41G 5/00; A41G 5/002; A41G 5/004; A41G 5/0046; A41G 5/0053
See application file for complete search history.

(56) References Cited

U.S. PATENT DOCUMENTS

2001/0035192 A1 11/2001 Townsend
2005/0098191 A1 5/2005 Frazier
(Continued)

FOREIGN PATENT DOCUMENTS

JP H07229009 A 8/1995
JP 2000303239 A 10/2000

OTHER PUBLICATIONS

International Search Report issued in corresponding International Application No. PCT/JP2019/039664, dated Dec. 17, 2019, with translation (5 pages).

(Continued)

*Primary Examiner* — Rachel R Steitz
(74) *Attorney, Agent, or Firm* — Osha Bergman Watanabe & Burton LLP

(57) ABSTRACT

The present invention provides artificial hair, an artificial hair unit, a method of applying artificial hair, and a method of applying an artificial hair unit, in which a fiber bundle does not hang down under its own weight, rises up, and exhibits excellent appearance with extra volume at a root. Also provided is a configuration including a base material, a plurality of fiber bundles, and a fixing thread. In the configuration, the base material may have a first side extending in a first direction. Each of the plurality of fiber bundles includes a plurality of fiber parts and a connecting part, where the connecting part connects a first end side of each of the plurality of fiber parts and extends in a direction different from an extending direction of the plurality of fiber parts, and where the fixing thread attaches a vicinity of the connecting part to the base material.

12 Claims, 14 Drawing Sheets

(56) References Cited

U.S. PATENT DOCUMENTS

| | | | | |
|---|---|---|---|---|
| 2007/0221240 | A1* | 9/2007 | Junsuh Lee | A41G 5/004 132/201 |
| 2008/0257369 | A1* | 10/2008 | Poole | A41G 5/004 132/53 |
| 2010/0065078 | A1* | 3/2010 | Reece | A41G 5/006 132/54 |
| 2011/0017228 | A1* | 1/2011 | Freelove | A41G 5/0046 132/201 |
| 2014/0299145 | A1* | 10/2014 | Chira | A41G 5/004 132/53 |
| 2018/0035737 | A1* | 2/2018 | Alex | A41G 3/0075 |

OTHER PUBLICATIONS

Written Opinion issued in corresponding International Application No. PCT/JP2019/039664, dated Dec. 17, 2019 (4 pages).
International Preliminary Report on Patentability issued in corresponding International Patent Application No. PCT/JP2019/039664 dated Apr. 8, 2021 (7 pages).

* cited by examiner

ARTIFICIAL HAIR, ARTIFICIAL HAIR UNIT, ARTIFICIAL HAIR APPLICATION METHOD, AND METHOD OF APPLYING ARTIFICIAL HAIR UNIT

TECHNICAL FIELD

One or more embodiments of the present invention relate to artificial hair, an artificial hair unit, a method of applying artificial hair, and a method of applying an artificial hair unit.

BACKGROUND

One conventional method of changing hairstyles is to attach weaving.

The weaving, which is sewn directly onto base hair of a user, can be attached in accordance with a size of the head of the user, without any concern about misalignment or detachment, allowing fine modification of parting, weight, and the like.

PATENT DOCUMENTS

Patent Document 1: JP 2000-303239 A

In conventional weaving it is difficult to give a three-dimensional effect to a root of the weaving for a hairstyle other than a style with extra volume as a whole such as afro (for example, straight hair). That is, the weaving hangs down from the root under its own weight and becomes flat. Thus, in order to give a three-dimensional effect to the root, there has been no other way but to rely on skills of a professional stylist during attachment, or to purchase weaving specially processed to increase the volume.

SUMMARY

One or more embodiments of the present disclosure relate to providing artificial hair, an artificial hair unit, a method of applying artificial hair, and a method of applying an artificial hair unit, in which a fiber bundle does not hang down under its own weight and easily rises up, and exhibits an excellent appearance with an extra volume at a root.

One or more embodiments of the present invention relate to artificial hair including: a base material; a plurality of fiber bundles; and a fixing thread, wherein the base material has a first side extending in a first direction as a whole, wherein each of the plurality of fiber bundles includes a plurality of fiber parts and a connecting part, wherein each of the plurality of fiber parts is a linear body including a first end, wherein the connecting part connects a first end side of each of the plurality of fiber parts and extends in a direction different from an extending direction of the plurality of fiber parts, wherein the fixing thread attaches a vicinity of each of the connecting part of the plurality of fiber bundles to the base material, and wherein the plurality of fiber bundles include an inclined fiber bundle sewn with the fixing thread such that the connecting part is inclined at a first inclination angle with respect to the first direction when the base material is viewed in a plan view.

The term "linear body" as used herein refers to a continuous elongated object such as a thread, and includes not only an object extending straight, but also a curved or bent object, a spiral object, or an arcuate object. The same applies hereinafter.

The term "vicinity of the connecting part" as used herein refers to a position in which the fiber parts between the fixing thread and the connecting part are close to an extent that the fiber parts do not significantly bend, for example a position within a range of 0.5 cm.

In one or more embodiments of the present invention, the fiber bundles include an inclined fiber bundle inclined at a predetermined angle, and thus when the base material hangs down such that the first side of the base material is horizontal, the inclined fiber bundle does not hang down under its own weight and easily rises up as compared to when the fiber bundles are arranged in a straight line so as to be parallel to the first side. Thus, when the base material is attached to the cap member attached to the head of the user or the hair on the head, the inclined fiber bundle stands up from a connected part with the base material and exhibits an excellent appearance with an extra volume at a root (connected part).

In one or more embodiments of the present invention, the first inclination angle is 5 degrees or more and 60 degrees or less.

In one or more embodiments of the present invention, the plurality of fiber bundles include a plurality of the inclined fiber bundles, each of the plurality of the inclined fiber bundles including the connecting part arranged side by side at an interval.

In one or more embodiments of the present invention, a difference in the first inclination angles of the inclined fiber bundles adjacent to each other is three degrees or less.

In one or more embodiments of the present invention, the base material is configured to be attached to a cap member attached to a head of a user or hair on the head, wherein the plurality of fiber bundles include a parallel fiber bundle sewn with the fixing thread such that the connecting part is substantially parallel to the first direction of the base material, and the parallel fiber bundle is located closer to a crown than the inclined fiber bundle when the base material is attached to the cap member or the hair on the head.

In one or more embodiments of the present invention, the parallel fiber bundle overlaps a part of the inclined fiber bundle from outside when the base material is attached to the cap member or the hair on the head.

In one or more embodiments of the present invention, the plurality of fiber bundles includes a plurality of parallel fiber bundles sewn with the fixing thread such that the connecting part is substantially parallel to the first direction of the base material, and each of the parallel fiber bundles includes the connecting part arranged side by side at an interval in a direction orthogonal to the first direction.

The conventional weaving is done by directly sewing hung-down-waved-fiber (fiber bundle) to base hair. In general, most hung-down-waved-fiber (fiber bundle) have the same color and the same length of fiber bundles, whereas human hair has different colors and lengths one by one. It has been therefore difficult to express a natural hue peculiar to human hair by using hung-down-waved-fiber (fiber bundle).

Further, manufacturing cost of hung-down-waved-fiber have increased in order to manufacture hung-down-waved-fibers including multiple fibers having different colors or fibers having different lengths.

In one or more embodiments for using monochromatic fiber bundles (hung-down-waved-fibers) and expressing a desired hue by entwining a plurality of fiber bundles (hung-down-waved-fibers), the plurality of fiber bundles include a first fiber bundle and a second fiber bundle, a fiber part of the first fiber bundle and a fiber part of the second fiber bundle having a different color, the connecting part of the first fiber bundle is adjacent to the connecting part of the second fiber bundle, and wherein the first fiber bundle and the second fiber bundle are disposed so as to partially overlap when the base material hangs down.

Embodiments related to the present invention may be directed to artificial hair having a base material and a plurality of fiber bundles, in which the base material is attached to a cap member that can be attached to a head of a user or hair on the head, each fiber bundle of the plurality of fiber bundles has a plurality of fiber parts and a connecting part, the connecting part connects one end of each of the plurality of fiber parts and extends in a predetermined direction, each of the plurality of fiber parts is a linear body and intersects with an extending direction of the connecting part, the plurality of fiber bundles includes fiber bundles having different colors of fiber parts, the connecting part of one fiber bundle is attached to the base material so as to be adjacent to the connecting part of another fiber bundle having a different color, and the one fiber bundle and the another fiber bundle are disposed so as to partially overlap when the base material hangs down.

The term "one end" as used herein means that a side closer to one end than a center in a longitudinal direction.

In one or more embodiments of the present invention, the fiber bundles adjacent to each other having a different color and partially overlapping are used. Thus, though each fiber bundle itself is monochromatic, a desired hue can be expressed by entwining the multiple fiber bundles having a different color.

Further, in one or more embodiments of the present invention, the connecting part of each of the fiber bundles extends in the predetermined direction (direction different from the extending direction of the fiber parts). It is therefore possible to overlap the multiple fiber bundles having a different color with a spread and express a natural hue more similar to human hair.

In one or more embodiments of the present invention, the plurality of fiber bundles includes at least three types of fiber bundles having a different color.

In one or more embodiments of the present invention, the fiber bundles having the fiber parts of an identical color are connected by the connecting part.

In one or more embodiments of the present invention, the connecting part of the second fiber bundle is located on a projection of the first fiber bundle (one fiber bundle) in a direction orthogonal to the first direction (extending direction of one side) when the base material is viewed in a plan view.

The term "extending in one direction as a whole" as used herein refers to extending with an orientation toward one direction when the base material is viewed as a whole, and this includes being partially slightly curved or bent.

Similarly, "extending in the first direction as a whole" refers to extending with an orientation toward the first direction when the base material is viewed as a whole, and this includes being partially slightly curved or bent.

In one or more embodiments of the present invention, a shortest distance between the connecting part of the first fiber bundle and the connecting part of the second fiber bundle is 0.2 cm or more and 2 cm or less.

In one or more embodiments of the present invention, the base material has a mesh shape and is provided with a plurality of ventilation holes through which air can pass.

In one or more embodiments of the present invention, the fiber parts are arranged in a row in an extending direction of the connecting part by the connecting part.

In one or more embodiments of the present invention, the base material includes a non-fiber region to which the plurality of fiber bundles are not attached when the base material is viewed in a plan view, and the non-fiber region is located closer to the first side than the plurality of fiber bundles.

In one or more embodiments of the present invention, the plurality of fiber bundles are hung-down-waved-fibers.

One or more embodiments of the present invention relate to an artificial hair unit including: the artificial hair described above; a cap member having a braided part; and an attachment thread, wherein the base material is sewn onto the braided part with the attachment thread.

One or more embodiments of the present invention relate to methods of applying the artificial hair described above, wherein the base material includes a non-fiber region to which the plurality of fiber bundles are not attached when the base material is viewed in a plan view, and wherein the non-fiber region is located closer to the first side than the plurality of fiber bundles, the method including cutting out a part or all of the non-fiber region.

One or more embodiments of the present invention relate to methods of applying the artificial hair described above, the methods including entwining the first fiber bundle (one fiber bundle) and the second fiber bundle (another fiber bundle).

In one or more embodiments of the present invention, the multiple fiber bundles having a different color are entwined, and thus a natural hue can be achieved.

One or more embodiments of the present invention relate to methods of applying the artificial hair unit described above, the methods including: forming an opening in the cap member; covering the head of the user with the cap member; and taking a part of hair of the user out of the opening.

In one or more embodiments of the present invention, the fiber bundles do not hang down under their own weight and easily rise up, and can exhibit an excellent appearance with an extra volume at the root.

BRIEF DESCRIPTION OF DRAWINGS

FIG. 9A is a perspective view of the artificial hair to be attached to the hair of the user, FIG. 9B is a perspective view of the artificial hair having been attached to the hair of the user, and FIG. 9C is a perspective view of a state in which the hair of the user is loosened.

FIG. 13A is a perspective view of the artificial hair unit in the case of being attached to the head of the user, FIG. 13B is a perspective view of the artificial hair unit having been attached to the head of the user, and FIG. 13C is a perspective view of a state in which the hair of the user is loosened.

DETAILED DESCRIPTION OF THE EMBODIMENTS

Hereinafter, one or more embodiments of the present invention will be described in detail. In a vertical direction, a crown of the head is at a top, and a forehead and a neckline are at a bottom.

Figure 1:
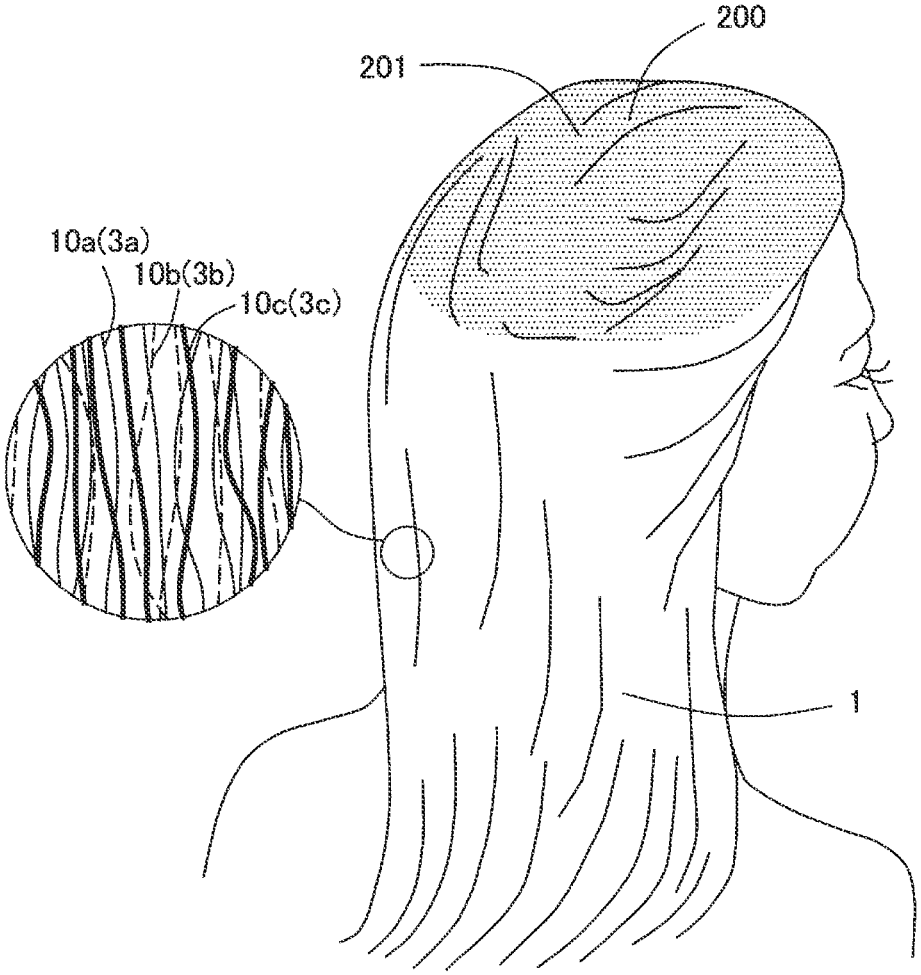
FIG. 1 is a perspective view schematically showing a usage state of artificial hair according to one or more embodiments of the present invention, and indicating hair of a user by dots.
Figure 2:
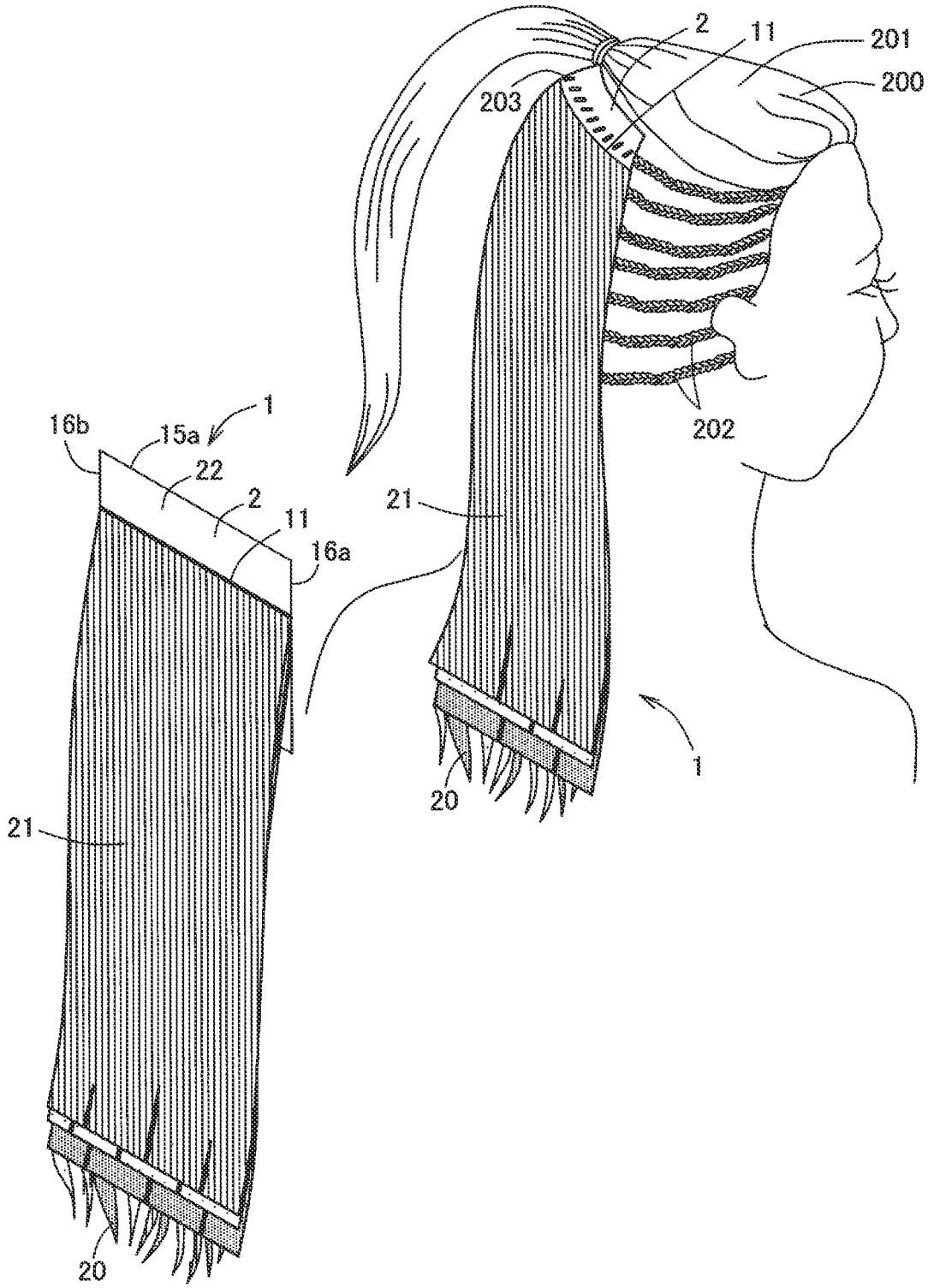
FIG. 2 is a perspective view of the artificial hair in FIG. 1 removed from the head of the user.

As shown in FIGS. 1 and 2, artificial hair 1 according to or more embodiments of the present invention is attached to a braided part 202 of hair 201 on a head 200 of a user, functions as imitation hair, and is used when weaving is attached.

Figure 3:
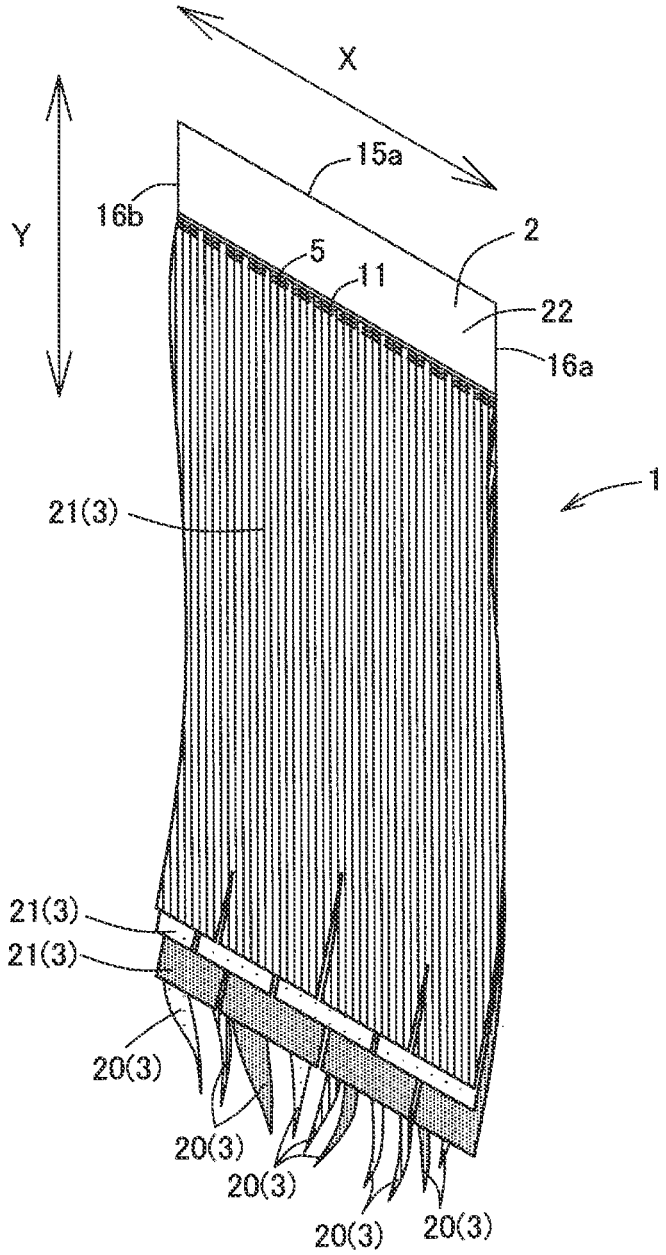
FIG. 3 is a perspective view of the artificial hair in FIG. 2.
Figure 4:
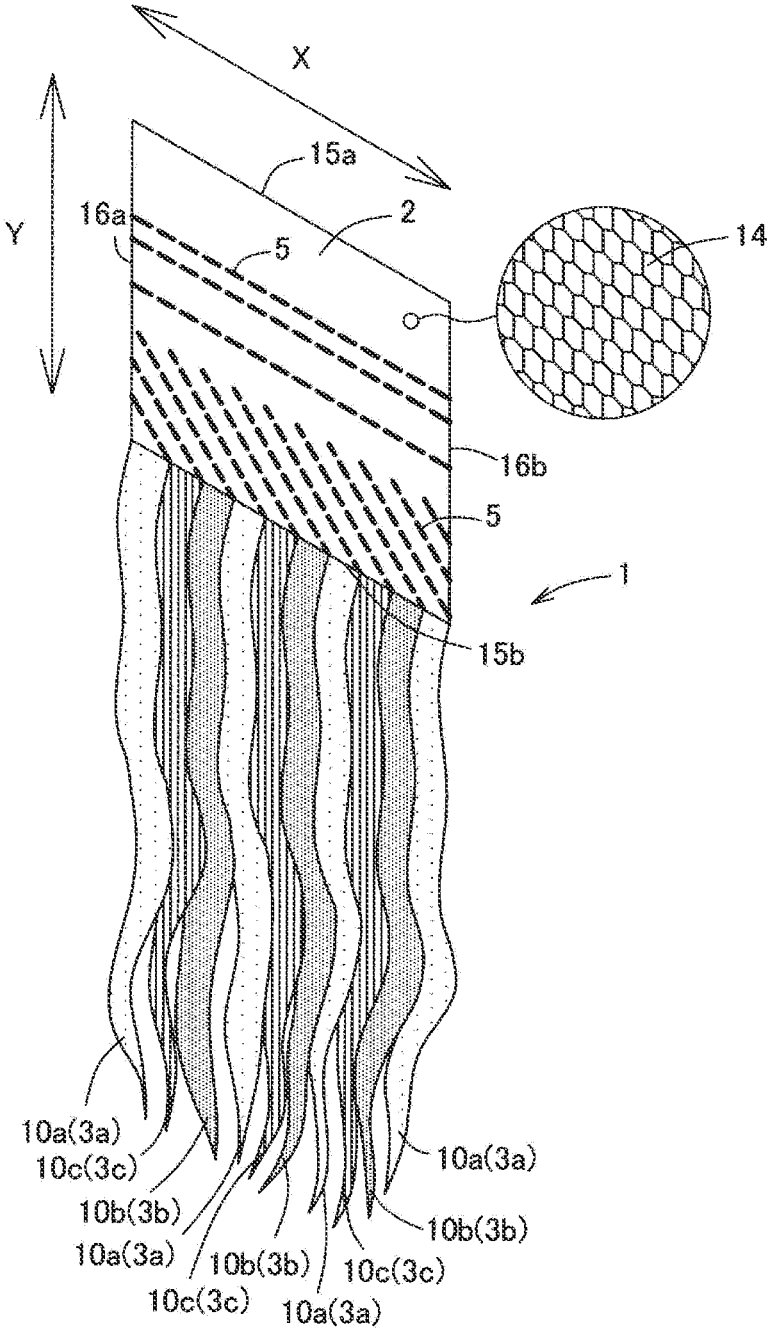
FIG. 4 is a perspective view of the artificial hair in FIG. 3 as viewed from another direction.

As shown in FIGS. 3 and 4, the artificial hair 1 mainly includes a base material 2, a plurality of fiber bundles 3 (3*a* to 3*c*), and a fixing thread 5.

As shown in FIG. 2, the base material 2 is attached to the braided part 202 in which the hair 201 is braided in advance.

The base material 2 is made of resin, is a mesh-like member spreading in a plane shape, and is a net member provided with a plurality of ventilation holes 14 through which air can pass. Specifically, the base material 2 is a honeycomb mesh having hexagonal openings when viewed in a plan view, as shown in the enlarged view of FIG. 4, and is air-permeable and stretchable in a spreading direction.

As shown in FIG. 4, the base material 2 is a sheet-like body spreading in one direction (hereinafter, also referred to as lateral direction X) and in a direction orthogonal to the one direction (hereinafter, longitudinal direction Y).

The base material 2 according to one or more embodiments of the present invention has a quadrangular shape, and includes lateral sides 15*a* and 15*b* (one side, first side) extending in the lateral direction X (first direction) as a whole and longitudinal sides 16*a* and 16*b* extending in the longitudinal direction Y as a whole. That is, the longitudinal sides 16*a* and 16*b* are orthogonal sides extending in the direction orthogonal to the lateral sides 15*a* and 15*b* as a whole.

Figure 5:
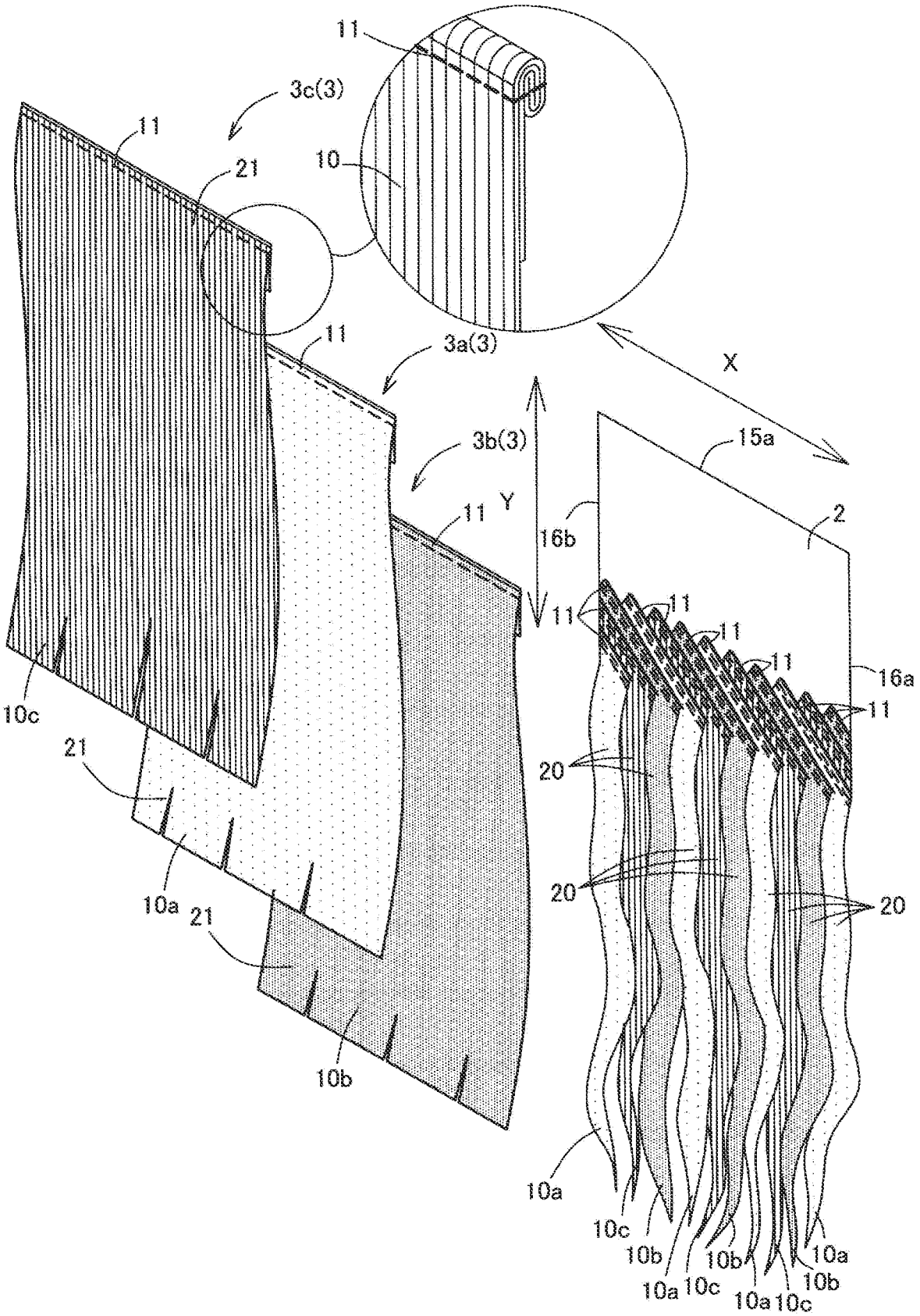
FIG. 5 is an exploded perspective view of the artificial hair in FIG. 3.
Figure 6:
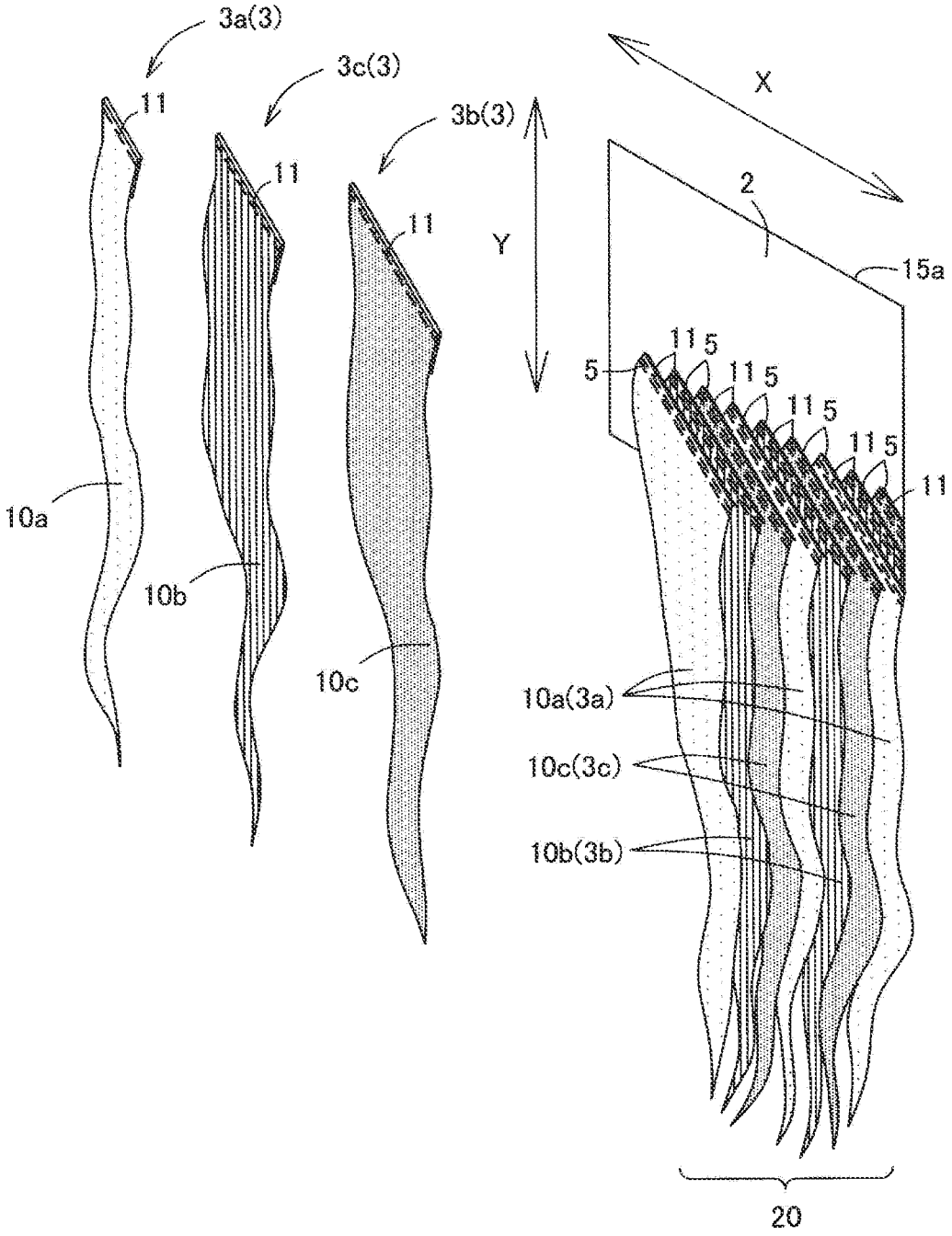
FIG. 6 is a further exploded perspective view of the artificial hair in FIG. 5.
Figure 7:
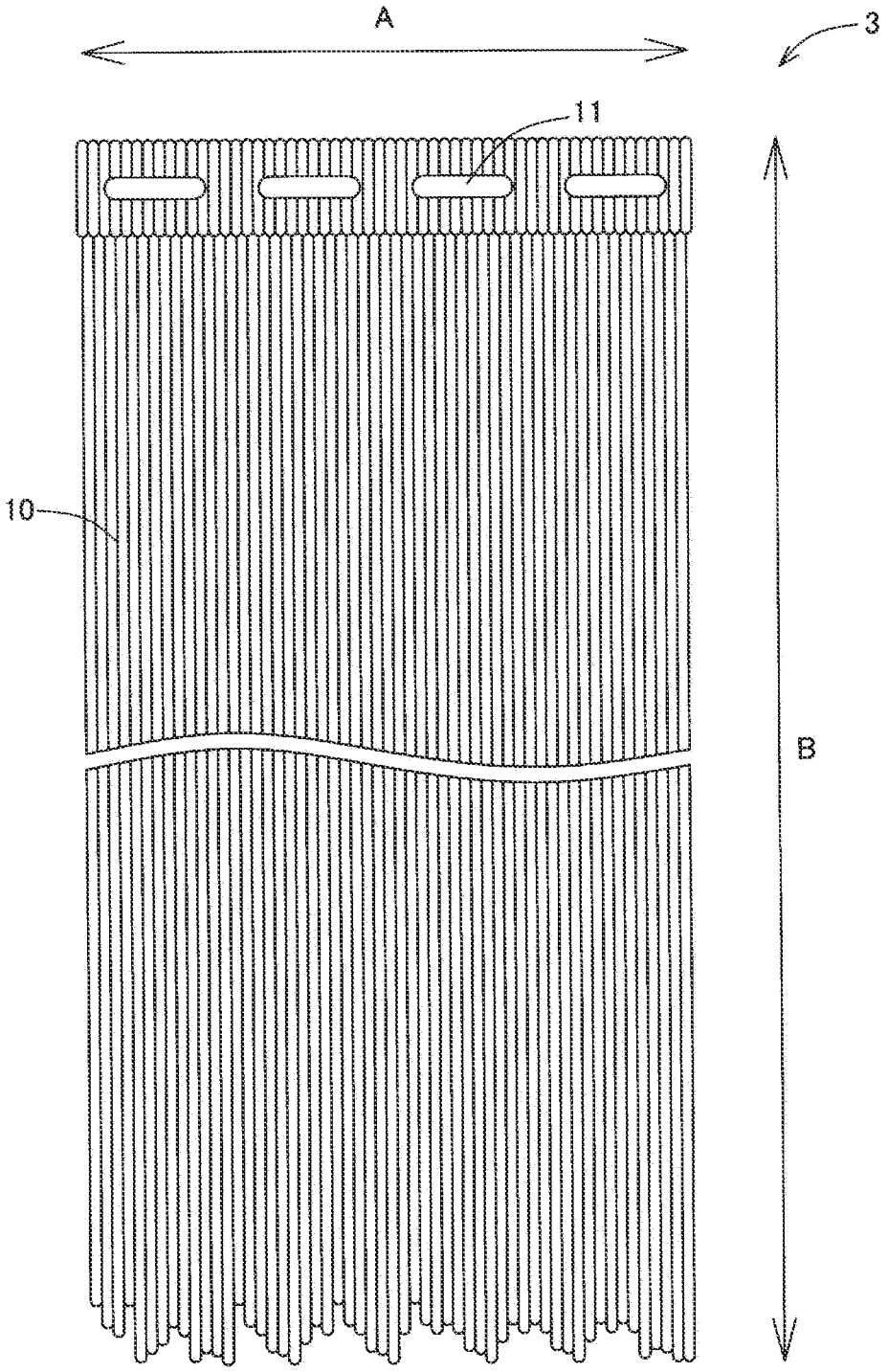
FIG. 7 is a plan view of a fiber bundle in FIG. 6.

As shown in FIGS. 5 to 7, the fiber bundles 3 (3*a* to 3*c*) are monochromatic hung-down-waved-fiber including a plurality of fiber parts 10 and a connecting part 11, are colored, and all the fiber parts 10 belonging to each own fiber bundle have an identical color.

Further, in the fiber bundles 3, a vicinity of one end of each of the fiber parts 10 is folded back a plurality of times, and the connecting part 11 is provided at the folded part.

The fiber parts 10 are fibers that imitate hair and are bendable linear bodies.

As described above, the fiber parts 10 are folded back, and one end of the fiber parts 10 is directed toward the other end.

As the fiber parts 10, synthetic fibers and natural hair such as human hair and animal hair can be used. In particular, as the fiber parts 10, KANEKARON (registered trademark) manufactured by KANEKA CORPORATION can be favorably used for its self-extinguishing property and unlikeliness to cause melting and drip, for example, collagen protein fibers, vinyl chloride fibers, vinylidene chloride fibers, acrylic fibers, and flame-retardant polyester fibers.

The connecting part 11 is a part connecting an intermediate part (a folded and overlapping part) of each of the fiber parts 10 as shown in the enlarged view of FIG. 5, and specifically, a sewing thread. The connecting part 11 connects one end (first end) side such that the fiber parts 10 are arranged in a row.

As shown in FIG. 7, an extending direction of the connecting part 11 intersects a longitudinal direction of the fiber parts 10. That is, an extending direction A of the connecting part 11 is not parallel to an extending direction B of the fiber parts 10, but faces a different direction. In the present embodiment, the extending direction A of the connecting part 11 is orthogonal to the longitudinal direction of the fiber parts 10.

In the fiber bundles 3 attached to the base material 2, the fiber bundles 3*a* to 3*c* having a plurality of kinds of colors are mixed. In the fiber bundles 3 according to one or more embodiments of the present invention, as shown in FIGS. 5 and 6, a first fiber bundle 3*a*, a second fiber bundle 3*b*, and a third fiber bundle 3*c* having three different kinds of colors are mixed. In the drawing, the different colors are depicted by changing a type of hatching.

The first fiber bundle 3*a* is a fiber bundle having a fiber part 10*a* having a predetermined color.

The second fiber bundle 3*b* is a fiber bundle having a fiber part 10*b* having a color different from the color of the fiber part 10*a* of the first fiber bundle 3*a*.

The third fiber bundle 3*c* is a fiber bundle having a fiber part 10*c* having a color different from the color of the fiber part 10*a* of the first fiber bundle 3*a* and the color of the fiber part 10*b* of the second fiber bundle 3*b*.

As shown in FIGS. 3 and 4, the fixing thread 5 is a thread that fixes the fiber bundles 3 to the base material 2 and forms a seam.

A material of the fixing thread 5 is not limited, and may be natural fibers such as a silk thread or cotton thread, or synthetic fibers such as nylon or polyester.

Subsequently, a positional relationship of each part of the artificial hair 1 according to one or more embodiments of the present invention will be described.

Figure 8:
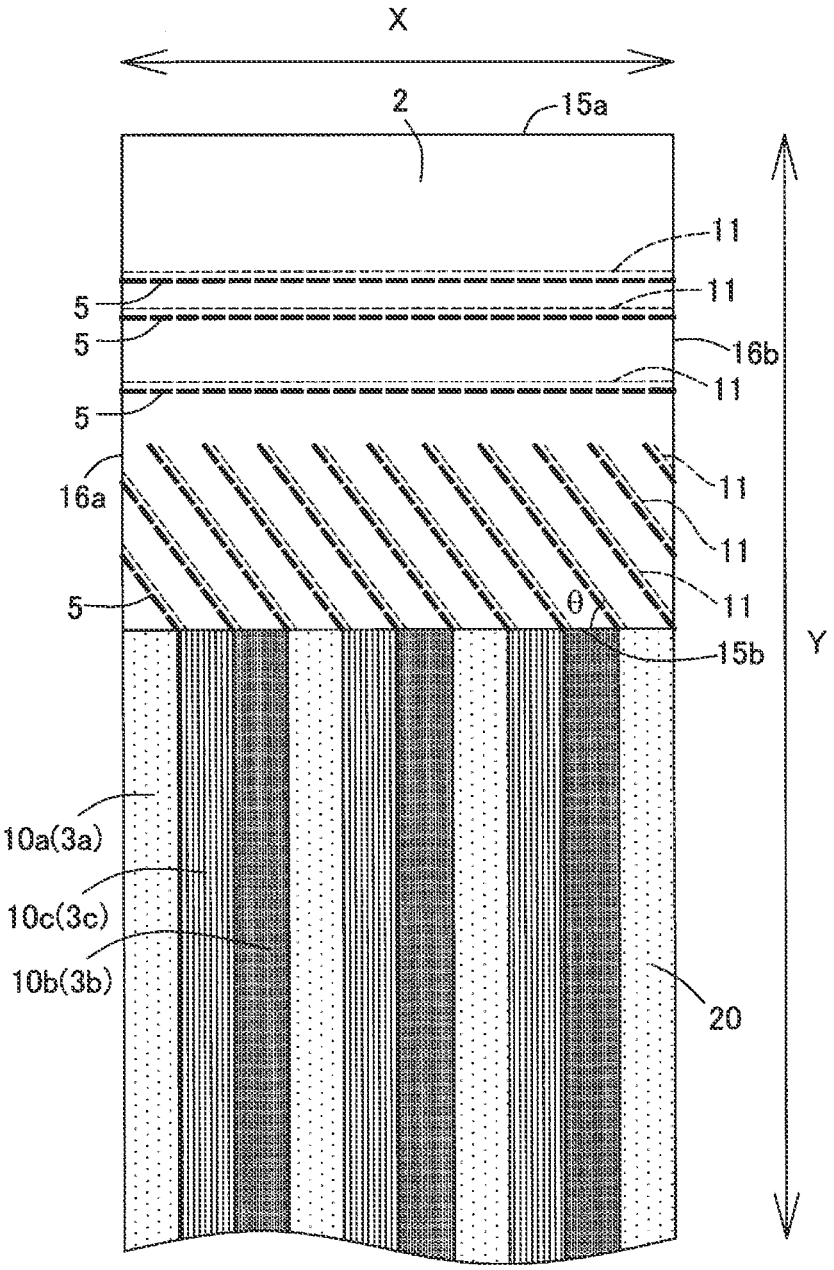
FIG. 8 is a plan view of the artificial hair in FIG. 3.

As shown in FIG. 4 the artificial hair 1 is fixed by sewing the plurality of fiber bundles 3*a* to 3*c* on one surface of the base material 2 with the fixing thread 5. Specifically, as shown in FIGS. 6 and 8, in the fiber bundles 3, a vicinity of the connecting part 11 is sewn along the connecting part 11 with the fixing thread 5, and the seam of the fixing thread 5 and the connecting part 11 are close to each other. In the present embodiment, the seam of the fixing thread 5 and the extending direction of each connecting part 11 are parallel.

A maximum distance between the connecting part 11 of the fiber bundles 3 and the seam of the fixing thread 5 is preferably more than 0 cm and 0.5 cm or less.

Within this range, an end of the fiber bundles 3 is unlikely to part from the base material 2.

As shown in FIG. 5, the fiber bundles 3 includes one or a plurality of inclined fiber bundles 20 in which the connecting part 11 extends inclined with respect to the lateral direction X and one or a plurality of parallel fiber bundles 21 in which the connecting part 11 extends in the lateral direction X.

The inclined fiber bundle 20 is a fiber bundle in which the connecting part 11 is fixed on the base material 2 by the fixing thread 5 and extends in a direction intersecting the lateral sides 15*a* and 15*b* of the base material 2. That is, as shown in FIG. 8, the connecting part 11 of the inclined fiber bundle 20 is not parallel to the lateral sides 15*a* and 15*b* when the base material 2 is viewed in a plane, but is inclined with a longitudinal component and a lateral component.

A first inclination angle θ of the connecting part 11 of the inclined fiber bundle 20 with respect to a lower side 15*b* shown in FIG. 8 is preferably 5 degrees or more and 60 degrees or less.

Within this range, the inclined fiber bundle 20 rises without hanging down under its own weight, and a volume at a root can be increased.

Further, a difference in the first inclination angles θ of the inclined fiber bundles 20 adjacent to each other is preferably three degrees or less.

Within this range, the connecting parts 11 of the inclined fiber bundles 20 substantially adjacent to each other are arranged in parallel, and thus more inclined fiber bundles 20 can be provided in a limited space.

As shown in FIG. 8, the connecting parts 11 which are the roots of the inclined fiber bundles 20 extend from a lower end to an intermediate part of the base material 2 in the longitudinal direction Y, and are disposed side by side in the lateral direction X at a predetermined interval.

The shortest distance between the connecting parts 11 of the inclined fiber bundles 20 adjacent to each other is preferably 0.2 cm or more and 2 cm or less.

Within this range, the fiber bundles 3 and 3 are likely to overlap each other, making it easy to express a desired hue.

As shown in FIG. 6, the inclined fiber bundle 20 includes the first fiber bundle 3*a*, the second fiber bundle 3*b*, and the third fiber bundle 3*c* having different colors.

As shown in FIG. 8, the first fiber bundle 3*a* configuring the inclined fiber bundle 20 is arranged adjacent to the second fiber bundle 3*b* configuring the inclined fiber bundle 20, and the second fiber bundle 3*b* configuring the inclined fiber bundle 20 is arranged adjacent to the third fiber bundle 3*c* configuring the inclined fiber bundle 20.

The connecting part 11 of the first fiber bundle 3*a* is parallel to the connecting part 11 of the second fiber bundle 3*b* at an interval, and the connecting part 11 of the second fiber bundle 3*b* is parallel to the connecting part 11 of the third fiber bundle 3*c* at an interval.

When an upper side 15*a* as an upper end of the base material 2 is held horizontally and hung down, the connecting part 11 of one inclined fiber bundle 20 is located on a projection in the vertical direction (longitudinal direction Y) of the connecting part 11 of another inclined fiber bundle 20, and the fiber parts 10 overlap a part of the fiber parts 10 of the another inclined fiber bundle 20.

As shown in FIGS. 3 and 8, the parallel fiber bundle 21 is a fiber bundle in which the connecting part 11 is fixed on the base material 2 by the fixing thread 5 and the connecting part 11 extends substantially parallel to the lateral sides 15*a* and 15*b*.

The connecting parts 11 of the parallel fiber bundles 21 are arranged side by side in the longitudinal direction Y as shown in FIG. 5. The parallel fiber bundle 21 according to one or more embodiments of the present invention is provided linearly over the entire lateral direction X.

A shortest distance between the connecting parts 11 and 11 of the parallel fiber bundles 21 adjacent to each other in the longitudinal direction Y is preferably 0.2 cm or more, and more preferably 0.5 cm or more. The shortest distance is preferably 2.5 cm or less, and more preferably 2 cm or less.

Within this range, the parallel fiber bundles 21 overlap each other and a gap between the parallel fiber bundles 21 can be obscured.

The parallel fiber bundle 21 also has the first fiber bundle 3*a*, the second fiber bundle 3*b*, and the third fiber bundle 3*c*, as shown in FIG. 5.

The first fiber bundle 3*a* configuring the parallel fiber bundle 21 is arranged adjacent to the second fiber bundle 3*b* configuring the parallel fiber bundle 21 in the longitudinal direction Y, and the second fiber bundle 3*b* configuring the parallel fiber bundle 21 is arranged adjacent to the third fiber bundle 3*c* configuring the parallel fiber bundle 21 in the longitudinal direction Y.

As shown in FIGS. 5 and 8, the connecting part 11 of the first fiber bundle 3*a* configuring the parallel fiber bundle 21 is parallel to the connecting part 11 of the second fiber bundle 3*b* configuring the parallel fiber bundle 21 at an interval in the longitudinal direction Y. Further, the connecting part 11 of the second fiber bundle 3*b* configuring the parallel fiber bundle 21 is parallel to the connecting part 11 of the third fiber bundle 3*c* configuring the parallel fiber bundle 21 at an interval in the longitudinal direction Y.

The parallel fiber bundle 21 is located above the inclined fiber bundle 20 when the upper side 15*a* as the upper end of the base material 2 is held horizontally and hung down as in FIG. 3. The parallel fiber bundle 21 is located closer to the crown than the inclined fiber bundle 20 when attached to the braided part 202 of the user as in FIG. 2. Thus, the root of the inclined fiber bundle 20 can be hidden by the parallel fiber bundle 21, and the root can be made natural like human hair.

The fiber parts 10 of the parallel fiber bundle 21 overlap a part of the fiber parts 10 of the lower parallel fiber bundle 21 when the upper side 15*a* as the upper end of the base material 2 is held horizontally and hung down, and at least a lowermost parallel fiber bundle 21 overlaps a part of the fiber parts 10 of the inclined fiber bundle 20.

As shown in FIG. 3, the artificial hair 1 according to one or more embodiments of the present invention has a non-fiber region 22 in which the fiber bundles 3 are not attached, above the connecting part 11 of an uppermost parallel fiber bundle 21 (hereinafter, also referred to as the uppermost connecting part 11). That is, the non-fiber region 22 is located closer to the upper side 15*a* (first side) than all the fiber bundles 3.

The non-fiber region 22 is a region where only the base material 2 is exposed and has a width in the longitudinal direction Y. The non-fiber region 22 is also a region that the user can hold for sewing the artificial hair 1 onto the braided part 202.

The width of the non-fiber region 22 is preferably ½ or less of a length of the longitudinal side 16*a* of the base material 2. Further, the width is preferably ¼ or more of the length of the longitudinal side 16*a* of the base material 2.

Within this range, the user can easily hold and fix the artificial hair 1 when braiding the artificial hair 1 onto the braided part 202.

Subsequently, a method of applying (attaching) the artificial hair 1 according to one or more embodiments of the present invention will be described. The following application method is an example, and one or more embodiments of the present invention is not limited thereto.

Figure 9A:
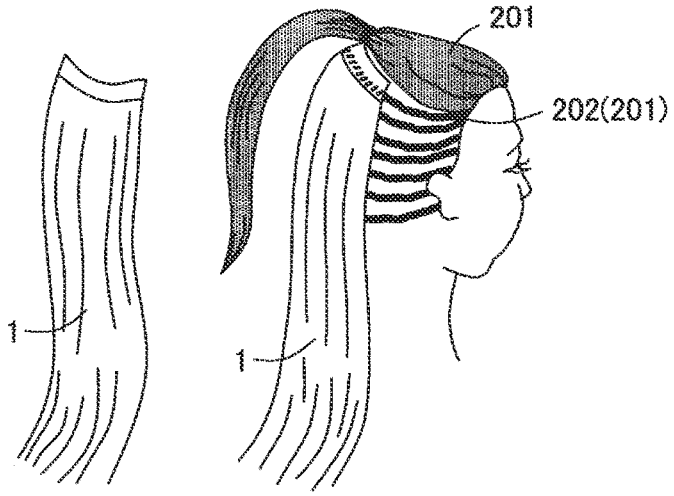
FIGS. 9A to 9C are explanatory views of the artificial hair in FIG. 1 when being attached.

As shown in FIG. 9A, the hair 201 is woven into a rope shape to form the braided part 202 in advance while leaving the hair 201 on the crown of the user.

At this time, the braided part 202 preferably extends in a head circumference direction.

Further, a method of braiding the hair 201 of the user is not limited as long as the artificial hair 1 can be fixed. For example, the method may be two interlacing, three interlacing, or four interlacing. As shown in FIG. 2, the braided part 202, according to one or more embodiments of the present invention, has a structure in which the user's own hair is braided, and is set in so-called cornrows.

Figure 9B:
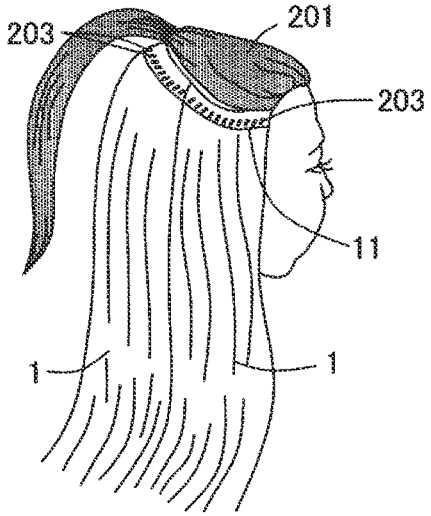
Figure 10:
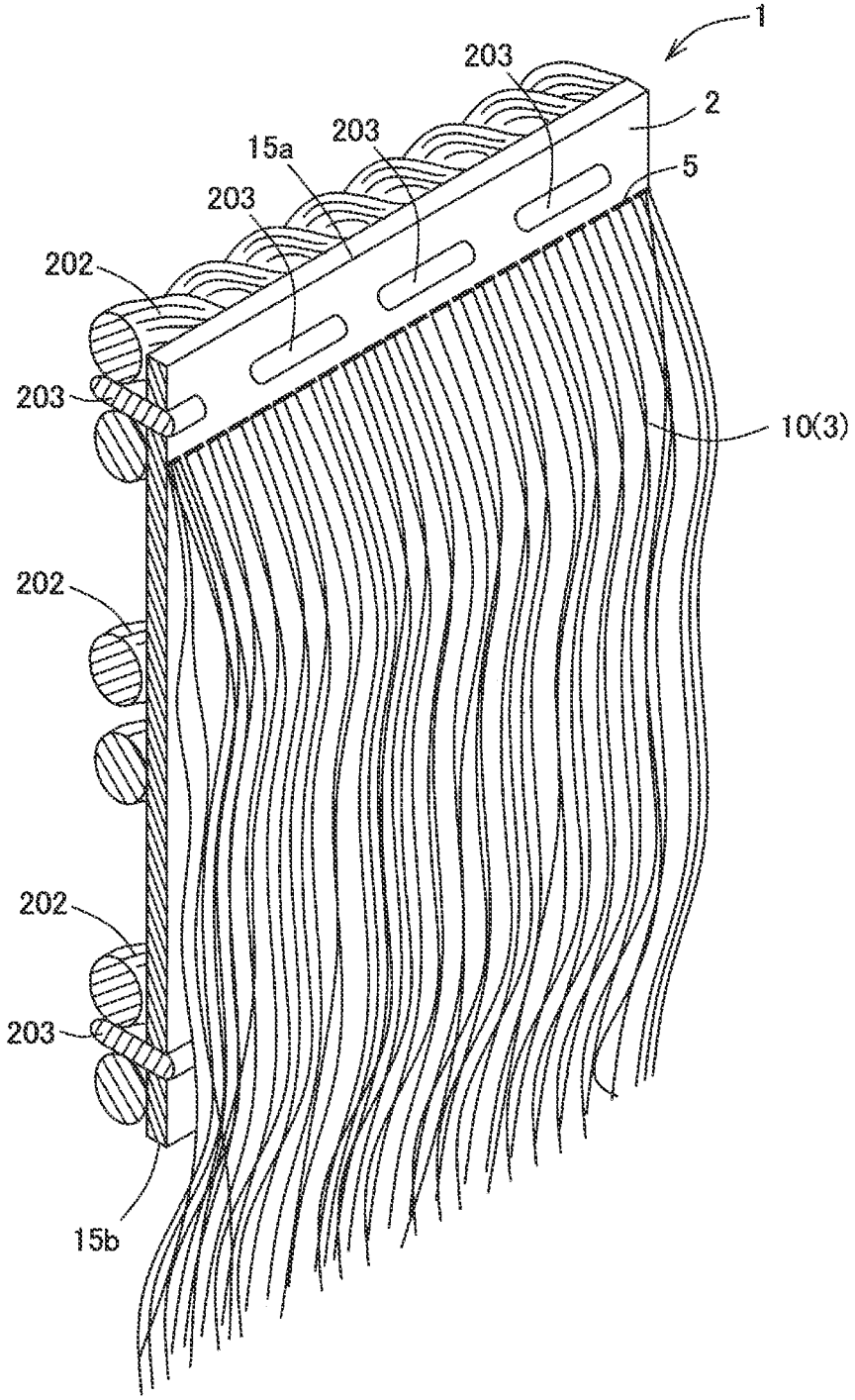
FIG. 10 is a sectional perspective view during a treatment to a braided part of the user.

Subsequently, as shown in FIGS. 9B and 10, at least a vicinity of the uppermost connecting part 11 of the base material 2 of the artificial hair 1 is sewn onto the braided part 202 along the upper side 15*a* with an attachment thread 203.

At this time, a curved needle or the like is used to blind stitch with the attachment thread 203 in a direction intersecting the extending direction of the braided part 202, and at least the vicinity of the uppermost connecting part 11 of the base material 2 is fixed along the upper side 15*a* to the braided part 202.

In the present embodiment, the artificial hair 1 is fixed to the two braided parts 202 in the vertical direction. Specifically, as shown in FIG. 10, a vicinity of the connecting part 11 is blind stitched along the upper side 15*a* and sewn onto one braided part 202, and further, a vicinity of the lower side 15*b* of the base material 2 is blind stitched along the lower side 15*b* and sewn onto another braided part 202 different from the one braided part 202. That is, the base material 2 is sewn and fixed to at least two vertical positions.

Subsequently, the fiber parts 10*a* to 10*c* of the fiber bundles 3*a* to 3*c* of the artificial hair 1 attached to the braided part 202 of the user are entwined and combed to adjust the fiber parts 10*a* to 10*c* as shown in the enlarged view of FIG. 1.

Figure 9C:
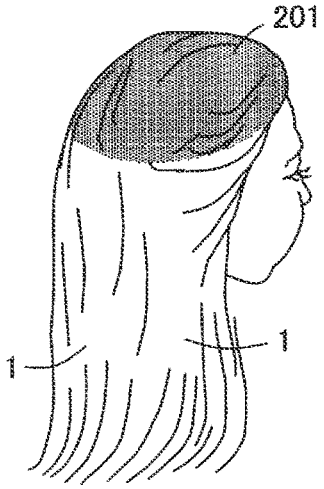

Then, a part or all of the non-fiber region 22 is cut out as appropriate, and the hair 201 near the crown is overlapped on the artificial hair 1 as shown in FIG. 9C.

In the artificial hair 1 according to one or more embodiments of the present invention, the monochromatic fiber bundle 3*a* is sewn onto the base material 2 in close proximity to the fiber bundles 3*b* and 3*c* having other colors, and the fiber parts 10 are partially overlapped with each other. It is therefore possible to obtain color mixing effects such as full mixed color, marble color, frost color, and piano color, and obtain a texture close to human hair.

The artificial hair 1 according to one or more embodiments of the present invention, in which each fiber bundle 3 includes the monochromatic fiber parts 10, can be manufactured in a factory with better productivity and achieve easier color management than artificial hair including fiber bundles composed of multiple fiber parts having different colors. This can reduce manufacturing costs, and allows consumers to enjoy high-priced colored goods such as wigs with low cost.

In the artificial hair 1 according to one or more embodiments of the present invention, the connecting parts 11 of the fiber bundles 3*a* to 3*c* adjacent to each other of different colors overlap on the projection in the longitudinal direction Y. Thus, the fiber parts 10 and 10 of different colors are likely to be entangled with each other and likely to express a desired hue.

In the artificial hair 1 according to one or more embodiments of the present invention, the fiber bundles 3 are sewn at the predetermined first inclination angle θ and at an arbitrary concentration in accordance with a hair design (straight, wave, curl, or other designs). Thus, the fiber bundles 3 rise up without hanging down under their own weight, the volume at the root can be increased and the appearance becomes more natural. In addition, lengths of hair tips are not the same, and thus the texture is natural.

In the artificial hair 1 according to one or more embodiments of the present invention, the base material 2 has a mesh shape and has the plurality of ventilation holes 14, and thus air permeability is good and the scalp is less likely to get steamed.

In the artificial hair 1 according to one or more embodiments of the present invention, the fiber parts 10 are arranged in a row by the connecting part 11, and thus more fiber bundles 3 can be attached to the base material 2 per unit area, and the fiber bundles 3 can be densely disposed.

In the artificial hair 1 according to one or more embodiments of the present invention, the inclined fiber bundle 20 is inclined, and thus the ends of the fiber parts 10 are not arranged in a straight line, and more natural hair tips with a three-dimensional effect can be reproduced. This allows the artificial hair 1 to be attached to the head of the user with the hair standing beforehand, which is more convenient than a conventional case where the hung-down-waved-fiber is manually attached to the head.

In the artificial hair 1 according to one or more embodiments of the present invention, the inclined fiber bundles 20 adjacent to each other in the lateral direction X partially overlap in a thickness direction of the base material 2. That is, adjacent to the outside of one inclined fiber bundle 20, another inclined fiber bundle 20 is located, making it possible to give a more three-dimensional effect and an extra volume.

In the artificial hair 1 according to one or more embodiments of the present invention, only by attaching each base material 2 to the hair on the head of the user one by one like a patchwork, the artificial hair 1 can be easily attached to the entire head of the user.

In the artificial hair 1 according to one or more embodiments of the present invention, when the vicinity of the connecting part 11 is blind-stitched to the braided part 202 with the attachment thread 203, the artificial hair 1 is easy to be held and fixed to the braided part 202 because the non-fiber region 22 is provided closer to the upper side 15*a* than all the fiber bundles 3.

The method of applying the artificial hair 1, according to one or more embodiments of the present invention, includes attaching the artificial hair 1 to the head 200 and then entwining the fiber parts 10, thus allowing fine adjustment of a hue.

In the method of applying the artificial hair 1 according to one or more embodiments of the present invention, the artificial hair 1 is sewn onto the braided part 202 in which the hair 201 of the user is braided. Thus, the artificial hair 1 can be perfectly fit to a shape of the own head 200 without any concern about displacement or detachment. Further, the method allows fine modification of hair designs such as parting and weights.

In one or more embodiments, the artificial hair 1 is directly attached to the hair 201 of the user, but one or more embodiments of the present invention is not limited thereto. The artificial hair 1 may be indirectly attached by using a cap member 102 that can be attached to the head 200 of the user. An example of this case will be described as an artificial hair unit 101 according to one or more embodiments of the present invention. The same configuration as the artificial hair 1, according to one or more embodiments of the invention, is numbered in the same manner and the description thereof will not be repeated.

Figure 11:
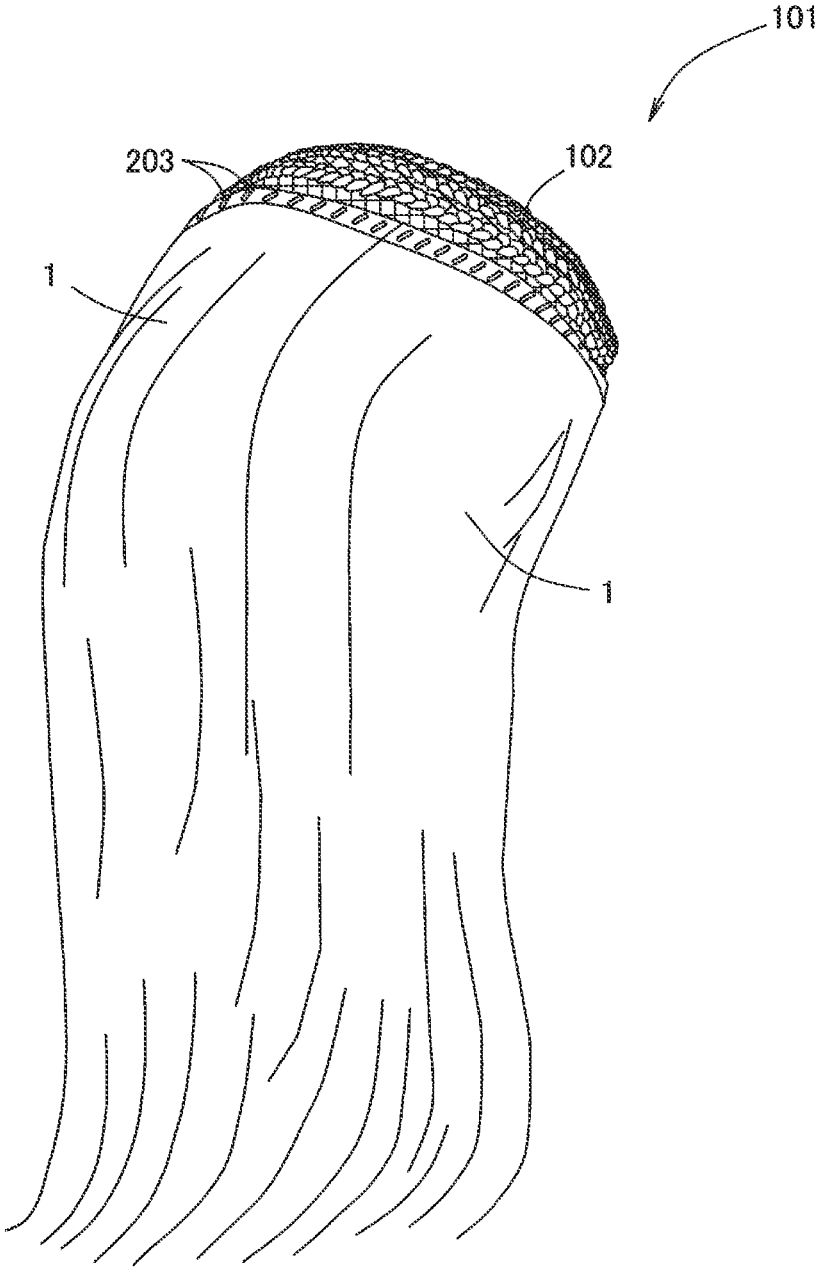
FIG. 11 is a perspective view schematically showing an artificial hair unit according to one or more embodiments of the present invention.

The artificial hair unit 101, according to one or more embodiments of the invention, is used to attach the artificial hair 1, according to one or more embodiments of the invention, to the head 200 of the user with the cap member 102. As shown in FIG. 11, the artificial hair unit 101 includes the artificial hair 1 and the cap member 102.

The cap member 102 is a covering member that can be attached to the head 200 of the user, and is specifically a wig cap.

Figure 12:
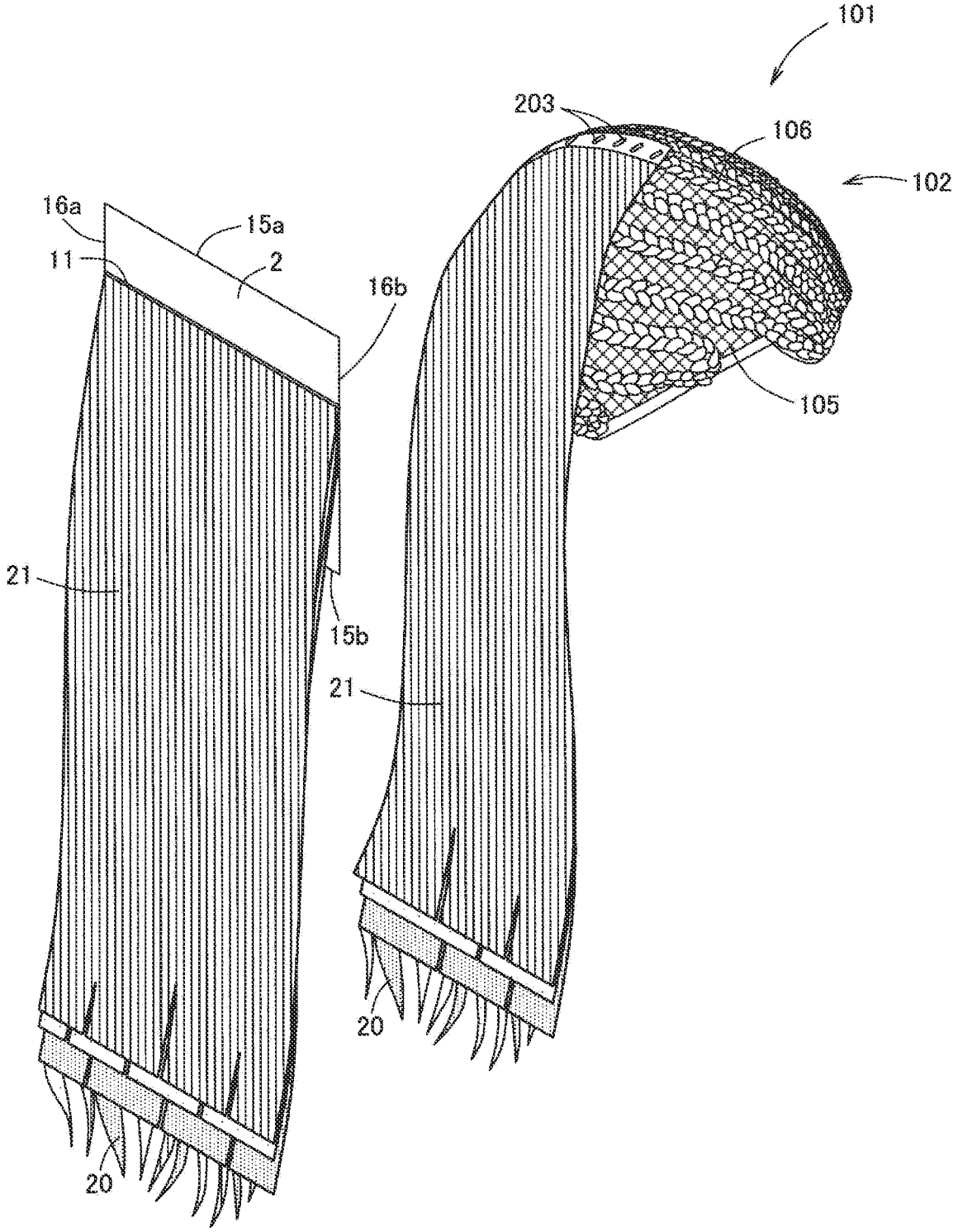
FIG. 12 is an exploded perspective view of the artificial hair unit in FIG. 11.

As shown in FIG. 12, the cap member 102 includes a base cap part 105 and a braided part 106.

The base cap part 105 is a mesh-like body curved along the head 200.

The braided part 106 is a part in which two bundle-shaped fibers are woven in two, and includes a plurality of fiber stitches. The braided part 106 is sewn so as to be curved on the base cap part 105, covering almost the entire base cap part 105.

Subsequently, a method of applying the artificial hair 1 when the artificial hair 1 is attached to the head 200 of the user using the cap member 102 will be described.

As shown in FIG. 12, on the cap member 102, at least the vicinity of the uppermost connecting part 11 of the base material 2 is sewn onto the braided part 106 along the upper side 15*a* with the attachment thread 203.

Figure 13A:
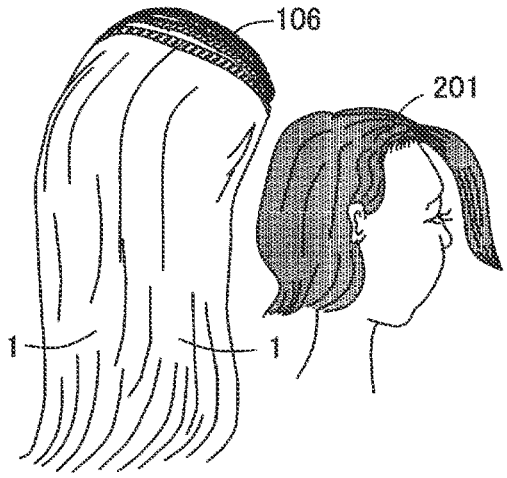
FIGS. 13A to 13C are explanatory views of the artificial hair unit in FIG. 11 when being attached.

Subsequently, as shown in FIG. 13, the cap member 102 is put on the head 200 of the user and fixed to the hair 201 of the user by a fixing part (not shown). Then, the fiber bundles 3 of the artificial hair 1 are entwined and combed.

Figure 13B:
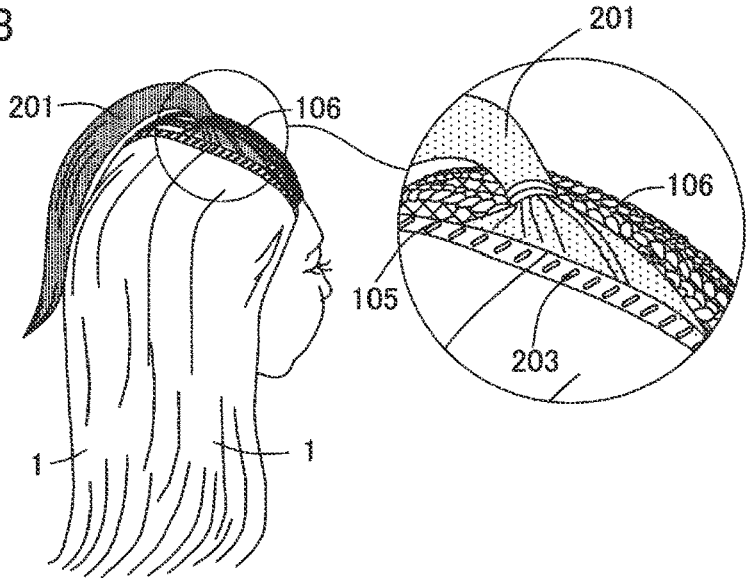
Figure 13C:
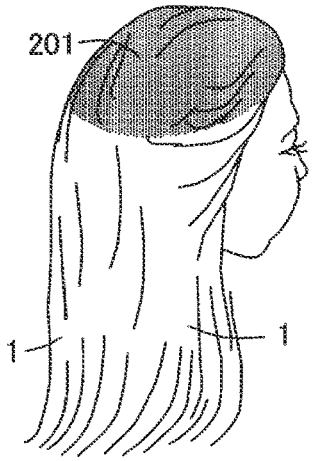

Next, the non-fiber region 22 is cut out as appropriate, an opening is provided in a part of the cap member 102 to take the hair 201 out of the opening as shown in FIG. 13B, and the hair 201 is overlapped with the artificial hair 1 as shown in FIG. 13C.

The artificial hair 1 according to one or more embodiments of the present invention is sewn onto the cap member 102, and can be pulled along the own head 200 and attached to the head 200, thereby allowing fine adjustment of a size.

In the method of applying the artificial hair 1 according to one or more embodiments of the present invention, the base material 2 of the artificial hair 1 is attached to the cap member 102 and then attached to the head 200. Thus, the user can apply the artificial hair alone without relying on a practitioner such as a stylist. In addition, by combining artificial hair 1 of various colors, shapes, and sizes that have been completed in advance and joining the combined artificial hair 1 to the cap member 102, weaving taking a short time and having a hair design close to an own image can be achieved without making use of an advanced styling technique.

Figure 14:
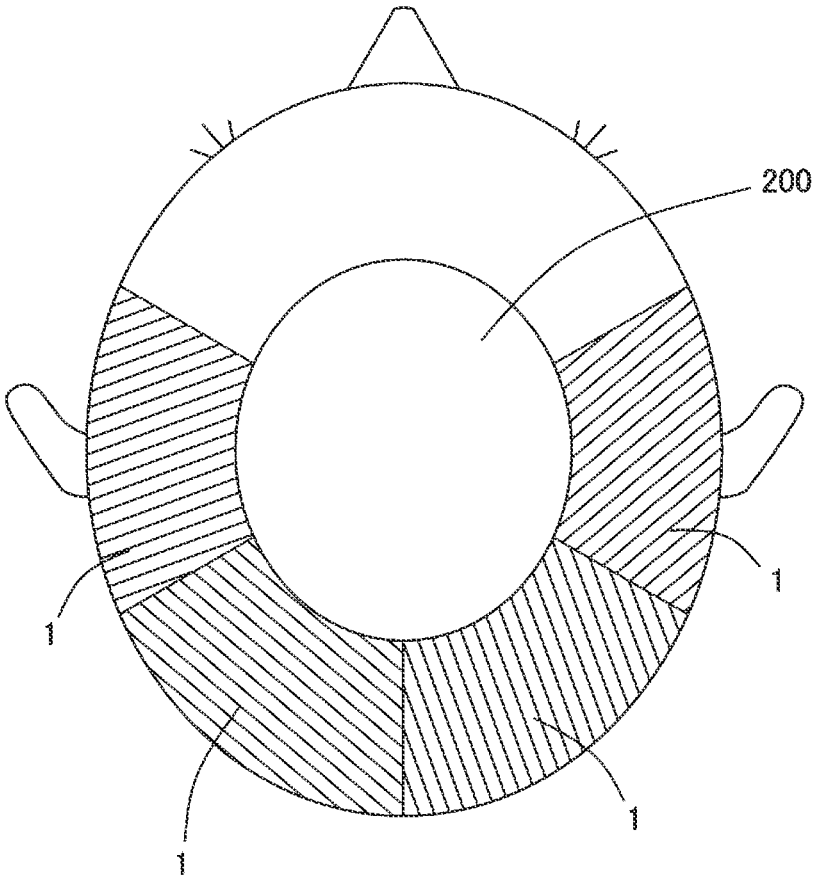
FIG. 14 is a plan view schematically showing the head of the user.

In the artificial hair 1 and the artificial hair unit 101 according to one or more embodiments of the present invention, only sewing four broad surfaces of the head 200 (for example, a frontal region, an occipital region, and left and right temporal regions shown in FIG. 14) will produce a generally completed whole structure, which helps the user imagine a final formation.

In addition, the parting and connections can be arranged into a desired design with the own hair or crochet goods. To arrange the own hair, an opening is provided in a part of the cap member 102 to take base hair out of the opening for arrangement, thereby enhancing a degree of freedom in hair designing.

In one or more embodiments, the fiber bundles 3 of three kinds of colors are used as the artificial hair 1, but one or more embodiments of the present invention is not limited thereto. The fiber bundles 3 of two kinds of colors may be used, or the fiber bundles 3 of four or more kinds of colors may be used.

In one or more embodiments, the fiber bundles 3 are attached to only one surface of the base material 2, but one or more embodiments of the present invention is not limited thereto. The fiber bundles 3 may be attached to both surfaces of the base material 2.

In one or more embodiments, the artificial hair 1 is attached to the head 200 or the cap member 102 and then the fiber parts 10 are entwined, but one or more embodiments of the present invention is not limited thereto. The artificial hair 1 may be attached to the head 200 or the cap member 102 after the fiber parts 10 of the respective colors are entwined.

In one or more embodiments, the sides of the base material 2 extend linearly, but one or more embodiments of the present invention is not limited thereto. The sides of the base material 2 may be partially curved as long as the sides extend as a whole.

In one or more embodiments, the connecting part 11 is formed by a sewing thread, but is not limited as long as the fiber parts 10 can be fixed. For example, the connecting part 11 may be configured by an adhesive such as bond or by a cloth.

In one or more embodiments, both the inclined fiber bundle 20 and the parallel fiber bundle 21 are provided, but one or more embodiments of the present invention is not limited thereto. It is sufficient that only the inclined fiber bundle 20 is provided.

In one or more embodiments, the connecting part 11 of each of the fiber bundles 3 extends linearly and is fixed to the base material 2, but one or more embodiments of the present invention is not limited thereto. The connecting part 11 of each of the fiber bundles 3 may be fixed to the base material 2 in a curved shape, may be fixed to the base material 2 in a circular shape, may be fixed to the base material 2 in a spiral shape, or may be fixed to the base material 2 in a zigzag shape.

In one or more embodiments, the inclined fiber bundles 20 are provided at an equal interval in the lateral direction X, but one or more embodiments of the present invention is not limited thereto. The intervals between the inclined fiber bundles 20 and 20 adjacent to each other do not have to be an equal interval. Similarly, the parallel fiber bundles 21 are provided at an equal interval in the longitudinal direction Y, but one or more embodiments of the present invention is not limited thereto. The intervals between the parallel fiber bundles 21 and 21 adjacent to each other do not have to be an equal interval.

In one or more embodiments, the base material 2 has a honeycomb mesh shape having hexagonal openings when viewed in a plan view, but one or more embodiments of the present invention is not limited thereto. The shape of the opening is not limited. The shape of the openings may have a circular shape, an elliptical shape, or a polygonal shape such as a triangle or a quadrangle. Further, when a material of the base material 2 itself is air-permeable, the base material 2 does not have to be provided with the openings.

In one or more embodiments, the parallel fiber bundles 21 are provided over the entire lateral direction X of the base material 2, but one or more embodiments of one or more embodiments of the present invention is not limited thereto. The parallel fiber bundles 21 may be provided in a part of the lateral direction X. Further, the plurality of parallel fiber bundles 21 may be arranged linearly in the lateral direction X.

In one or more embodiments, the non-fiber region 22 is provided near the upper end of the base material 2, but one or more embodiments of the present invention is not limited to this. The connecting part 11 may be used as the upper end of the base material 2 without providing the non-fiber region 22. Further, the non-fiber region 22 may be provided near the lower end of the base material 2.

In one or more embodiments, the connecting part 11 is the intermediate part of the fiber parts 10 and is provided at the folded part, but one or more embodiments of the present invention is not limited thereto. The connecting part 11 may be provided at the end of the fiber parts 10.

In one or more embodiments, the artificial hair 1 is attached to the user with the cornrows, but a hairstyle is not limited as long as the artificial hair 1 can be fixed to the hair 201 of the user. For example, the hairstyle of the user may be dreadlocks or braids.

In one or more embodiments, the braided part 202 is formed in almost an entire area of the head 200 of the user, but one or more embodiments of the present invention is not limited as long as the artificial hair 1 can be fixed to the braided part 202. The braided part 202 may be formed on a part of the head 200 of the user.

In one or more embodiments, the cap member 102 is fixed to the head 200 by the fixing part (not shown), but a method of fixing the cap member 102 to the head 200 is not limited. For example, the cap member 102 may be fixed to the head 200 with an adhesive such as bond, or the cap member 102 may be fixed to the head 200 with a thread or the like on the braided part 202 of the user.

In one or more embodiments, the fixing thread 5 is sewn closer to the upper side 15*a* (base end of the fiber bundles 3) with respect to the connecting part 11, but one or more embodiments of the present invention is not limited thereto. The fixing thread 5 may be sewn closer to the lower side 15*b* (distal end of the fiber bundles 3) with respect to the connecting part 11.

Although the disclosure has been described with respect to only a limited number of embodiments, those skilled in the art, having benefit of this disclosure, will appreciate that various other embodiments may be devised without departing from the scope of the present invention. Accordingly, the scope of the present invention should be limited only by the attached claims.

EXPLANATION OF REFERENCE SIGNS

1: Artificial hair
2: Base material
3, 3*a*-3*c*: Fiber bundle (first fiber bundle, second fiber bundle)
5: Fixing thread
10, 10*a*-10*c*: Fiber part
11: Connecting part
15*a*, 15*b*: Lateral side (one side, first side)
16*a*, 16*b*: Longitudinal side (orthogonal side)
20: Inclined fiber bundle
21: Parallel fiber bundle
22: Non-fiber region
101: Artificial hair unit
102: Cap member
200: Head
201: Hair
202: Braided part

The invention claimed is:

1. Artificial hair comprising:

a base material, wherein the base material has a first side extending in a first direction as a whole;

a plurality of fiber bundles; and a fixing thread, wherein:

each of the plurality of fiber bundles includes a plurality of fiber parts and a connecting part, each of the plurality of fiber parts is a linear body including a first end, the connecting part connects a first end side of each of the plurality of fiber parts and extends in a direction different from an extending direction of the plurality of fiber parts, the fixing thread attaches a vicinity of each of the connecting part of the plurality of fiber bundles to the base material, the plurality of fiber bundles include a first inclined fiber bundle and a second inclined fiber bundle sewn with the fixing thread such that the connecting part is inclined at a first inclination angle with respect to the first direction when the base material is viewed in a plan view, the connecting part of the first inclined fiber bundle is located on a projection line of the connecting part of the second inclined fiber bundle in the vertical direction when the first side of the base material is held horizontally and hung down, the connecting part of the first inclined fiber bundles and the connecting part of the second inclined fiber bundles are arranged side by side at an interval, the plurality of fiber bundles further include a plurality of parallel fiber bundles sewn with the fixing thread such that the connecting part is substantially parallel to the first direction of the base material, and each of the parallel fiber bundles includes the connecting part arranged side by side at an interval in a direction orthogonal to the first direction.

2. The artificial hair according to claim 1, wherein the first inclination angle is 5 degrees or more and 60 degrees or less.

3. The artificial hair according to claim 1, wherein a difference in the first inclination angles of the inclined fiber bundles adjacent to each other is three degrees or less.

4. The artificial hair according to claim 1, wherein the plurality of fiber bundles includes a first fiber bundle and a second fiber bundle where a fiber part of the first fiber bundle and a fiber part of the second fiber bundle have a different color, wherein the connecting part of the first fiber bundle is adjacent to the connecting part of the second fiber bundle, and wherein the first fiber bundle and the second fiber bundle are disposed so as to partially overlap when the base material hangs down.

5. The artificial hair according to claim 4, wherein the plurality of fiber bundles includes at least three types of fiber bundles having a different color.

6. The artificial hair according to claim 4, wherein the fiber bundles having the fiber parts of an identical color are connected by the connecting part.

7. The artificial hair according to claim 4, wherein the connecting part of the second fiber bundle is located on a projection line of the first fiber bundle in a direction orthogonal to the first direction when the base material is viewed in the plan view.

8. The artificial hair according to claim 4, wherein a shortest distance between the connecting part of the first fiber bundle and the connecting part of the second fiber bundle is 0.2 cm or more and 2 cm or less.

9. The artificial hair according to claim 1, wherein the base material has a mesh shape and is provided with a plurality of ventilation holes through which air can pass.

10. The artificial hair according to claim 1, wherein the fiber parts are arranged in a row in an extending direction of the connecting part by the connecting part.

11. The artificial hair according to claim 1, wherein the base material includes a non-fiber region where the plurality of fiber bundles are not attached when the base material is viewed in the plan view, and wherein the non-fiber region is located closer to the first side than the plurality of fiber bundles.

12. The artificial hair according to claim 1, wherein the fiber bundle is hung-down-waved-fiber.

* * * * *